US012741835B2

(12) United States Patent
Itabashi et al.

(10) Patent No.: US 12,741,835 B2
(45) Date of Patent: Sep. 22, 2026

(54) SHEET CONVEYANCE APPARATUS AND IMAGE FORMING APPARATUS

(71) Applicant: CANON KABUSHIKI KAISHA, Tokyo (JP)

(72) Inventors: Toshifumi Itabashi, Ibaraki (JP); Wataru Murata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 168 days.

(21) Appl. No.: 18/895,030

(22) Filed: Sep. 24, 2024

(65) Prior Publication Data

US 2025/0100822 A1 Mar. 27, 2025

(30) Foreign Application Priority Data

Sep. 27, 2023 (JP) ..... 2023-165480

(51) Int. Cl.
*B65H 1/26* (2006.01)
*B65H 3/08* (2006.01)

(52) U.S. Cl.
CPC ..... *B65H 1/266* (2013.01); *B65H 3/08* (2013.01); *B65H 2405/1144* (2013.01); *B65H 2405/31* (2013.01)

(58) Field of Classification Search
CPC . B65H 1/26; B65H 1/266; B65H 3/14; B65H 2405/30; B65H 2405/31; B65H 2405/324; B65H 2405/1117; B65H 2405/11172; B65H 2405/1144
USPC ..... 271/162, 248; 399/124
See application file for complete search history.

(56) References Cited

U.S. PATENT DOCUMENTS 5,120,045 A * 6/1992 Kamezaki ..... G03G 15/60 16/259
6,829,453 B2 * 12/2004 Kouzu ..... G03G 21/1638 399/124
7,515,849 B2 * 4/2009 Iketani ..... G03G 15/234 399/124
7,831,173 B2 * 11/2010 Kusukawa ..... G03G 21/1671 399/114
7,917,057 B2 * 3/2011 Koyanagi ..... G03G 15/16 399/110
8,401,426 B2 * 3/2013 Nieda ..... E05C 19/02 399/114

(Continued)

FOREIGN PATENT DOCUMENTS

JP H07309454 A 11/1995
JP 2006256819 A 9/2006

*Primary Examiner* — Leslie A Nicholson, III
(74) *Attorney, Agent, or Firm* — Canon U.S.A., Inc., IP Division

(57) ABSTRACT

Provided is a sheet conveyance apparatus that includes a housing in which a sheet conveyance unit configured to convey a sheet is stored, an opening and closing unit configured to open and close by rotating with respect to the housing, a feeding unit configured to feed a sheet, a rotation unit configured to support the opening and closing unit to rotate with respect to the housing, and a regulating unit configured to regulate the opening and closing unit. The rotation unit includes a rotating shaft that is attached to one of the opening and closing unit and the housing, and serves as a rotation center of the opening and closing unit in rotating, a first groove portion that is formed in the other of the opening and closing unit and the housing, and a lock unit configured to switch between locked and released states.

14 Claims, 11 Drawing Sheets

(56) References Cited

U.S. PATENT DOCUMENTS

| | | | | |
|---|---|---|---|---|
| 8,521,064 | B2 * | 8/2013 | Yamauchi | G03G 21/168 399/121 |
| 8,752,825 | B2 * | 6/2014 | Watanabe | G03G 21/1633 271/213 |
| 8,849,158 | B2 * | 9/2014 | Kamano | G03G 21/1638 399/121 |
| 9,042,770 | B2 * | 5/2015 | Sato | G03G 21/1633 49/394 |
| 9,944,476 | B2 * | 4/2018 | Omori | B65H 31/22 |
| 10,114,332 | B2 * | 10/2018 | Takahashi | G03G 21/1633 |
| 10,259,674 | B2 * | 4/2019 | Sato | B65H 31/24 |
| 10,603,935 | B1 * | 3/2020 | Yasui | G03G 21/1661 |
| 10,800,620 | B2 * | 10/2020 | Kannari | B65H 1/04 |
| 11,530,104 | B2 * | 12/2022 | Okazaki | B65H 11/02 |

* cited by examiner

SHEET CONVEYANCE APPARATUS AND IMAGE FORMING APPARATUS

BACKGROUND

Field

The present disclosure relates to a sheet conveyance apparatus that conveys a sheet and an image forming apparatus that uses the sheet conveyance apparatus.

Description of the Related Art

In recent years, image forming apparatuses using an electrophotographic method such as copying machines, printers, and facsimiles have been required to achieve high image quality. In order to achieve high image quality, special paper such as glossy coated paper of which a surface is coated with a coating agent is increasingly used.

In order to feed such special paper, for example, a manual feeding apparatus attached to a side wall of an image forming apparatus is used.

Japanese Patent Application Laid-Open No. 2006-256819 discusses a manual feeding apparatus that blows air to stacked sheets to reduce an adhesion force therebetween in order to stack and continuously feed a plurality of sheets of coated paper.

On the other hand, in a manual feeding apparatus, a configuration in which a tray for stacking sheets is attached to and removed from an apparatus main body is known.

Japanese Patent Application Laid-Open No. 7-309454 discusses a configuration in which a groove formed on a tray is rotatably engaged with a shaft provided in an apparatus main body, and the tray is fixed to the apparatus main body with a snap fit mechanism that elastically deforms in a state in which the tray is open.

In a case where a blowing unit such as a fan for blowing air onto stacked sheets is disposed on a tray, the tray will be larger and heavier. However, the manual feeding apparatus discussed in Japanese Patent Application Laid-Open No. 7-309454 uses the snap fit mechanism for holding the tray in the open state. In other words, the tray is held by a locking force of a lock of the snap fit mechanism. For a heavy tray, the locking force will increase in proportion to the weight. In that case, a load for releasing the locking force will also increase to remove the tray from the apparatus main body, which may reduce workability.

SUMMARY

The present disclosure is directed to the provision of a sheet conveyance apparatus that can improve workability in removing a tray and an image forming apparatus.

According to an aspect of the present, a sheet conveyance apparatus is provided that includes a housing including a sheet conveyance unit; an opening and closing unit configured to at least one of open and close by rotating with respect to the housing, to move between a closed position and an open position, the opening and closing unit including a support unit configured to support at least on sheet at the open position, with the opening and closing unit being detachably attached to the housing; a feeding unit configured to feed a sheet of the at least one sheet supported by the support unit to the sheet conveyance unit; at least one regulating unit configured to regulate the opening and closing unit in the open position; a shaft attached to one of the opening and closing unit and the housing, configured to serve as an axis for rotation of the opening and closing unit; a first groove portion that includes an opening extending in a direction perpendicular to the axis for detachably engaging the shaft; and a first lock unit configured to switch between engaging and releasing the shaft within/from the first groove portion.

Additional aspects and features of the present disclosure will become apparent from the following description of exemplary embodiments with reference to the attached drawings.

DESCRIPTION OF THE EMBODIMENTS

Figure 1:
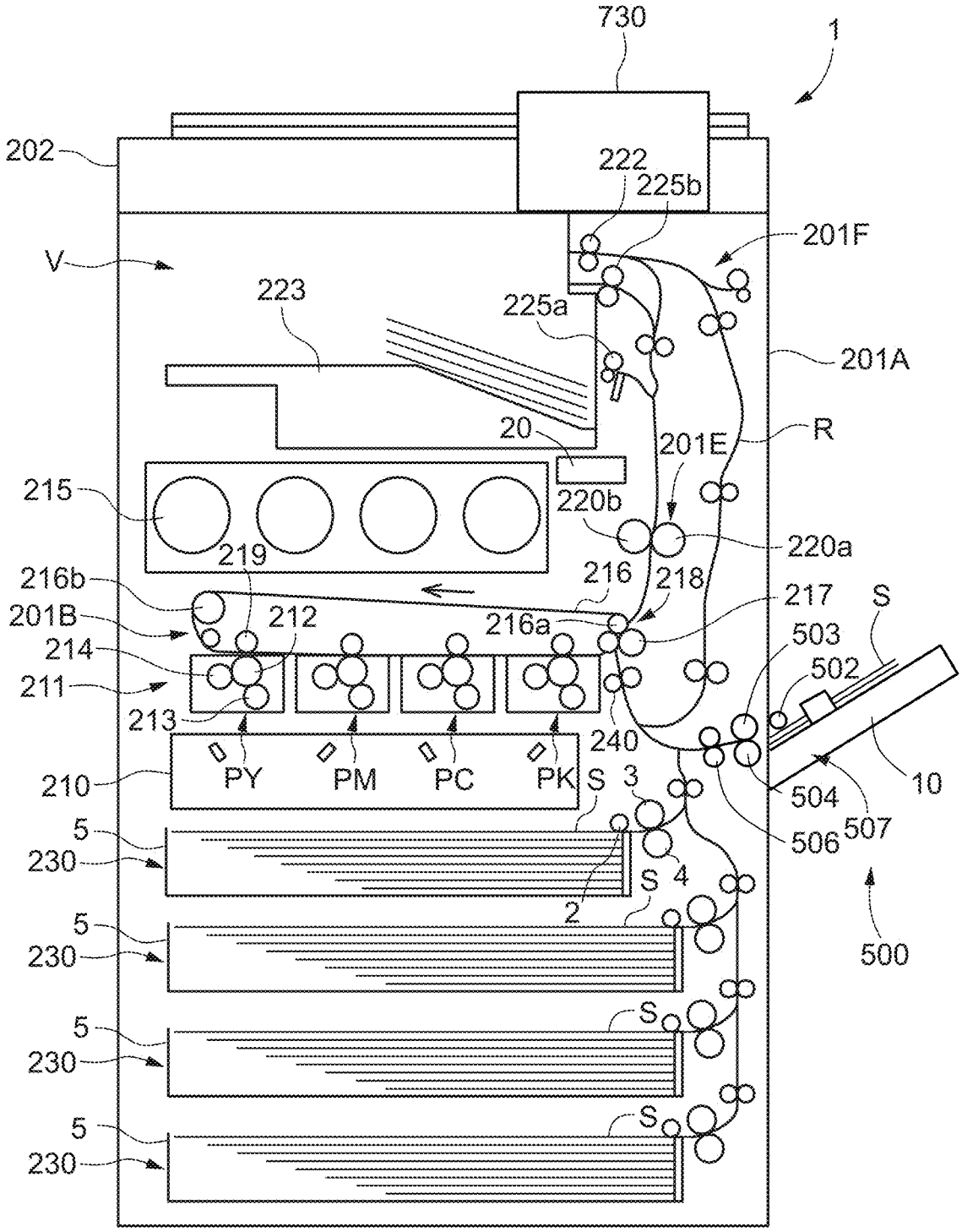
FIG. 1 is a cross-sectional view illustrating an image forming apparatus according to an exemplary embodiment.

Exemplary embodiments are described with reference to the attached drawings. A schematic configuration of an image forming apparatus 1 according to the present exemplary embodiment is described with reference to FIG. 1. FIG. 1 is a cross-sectional view illustrating the schematic configuration of the image forming apparatus 1 according to the present exemplary embodiment. The image forming apparatus 1 is a tandem intermediate transfer type laser beam printer using an electrophotographic process. The image forming apparatus 1 can form and output a full-color or a single-color image corresponding to print image data output from a host device connected to a control unit 20 on a sheet S, which is a recording medium.

The control unit 20 is a control unit that comprehensively controls operations of the image forming apparatus 1 and transmits and receives information to and from the host apparatus and an operation unit 730. The control unit 20 performs signal processing, sequence control, and the like with respect to various process devices. The host apparatus is a personal computer, an image scanner, a facsimile, or the like. The control unit 20 includes a central processing unit (CPU), a random access memory (RAM), and a read only memory (ROM), and controls each unit in the image forming apparatus 1. The CPU outputs an output signal to each electrical component to operate the electrical component at a desired timing and with a required control amount based on a detection signal input from various sensors and information stored in the ROM. Thus, it is the CPU that actually controls the electrical components. The ROM and the RAM store information data necessary for controlling each unit, and the CPU reads information data stored in the ROM and writes it to the RAM.

The image forming apparatus 1 includes an apparatus main body 201A and an image forming unit 201B that forms an image on the sheet S. An image reading apparatus 202 is disposed substantially horizontally above the apparatus main body 201A. A discharge space V for discharging a sheet is formed between the image reading apparatus 202 and the image forming unit 201B. According to the present exemplary embodiment, the apparatus main body 201A, more specifically, a frame of the apparatus main body 201A is an example of a housing. According to the present exemplary embodiment, the image forming apparatus 1 is also an example of a sheet conveyance apparatus. In other words, the image forming apparatus 1 as a sheet conveyance apparatus includes the apparatus main body 201A, and a manual feeding unit 500 and a feeding unit 507, which are described below (see FIG. 3).

A cassette feeding unit 230 feeds the sheet S from a feeding cassette 5, which is a sheet storage unit that stores the sheet S. The cassette feeding unit 230 includes a pickup roller 2 that feeds the sheet S stored in the feeding cassette 5 and a separating roller pair formed of a feeding roller 3 and a delay roller 4 for separating the sheet S fed by the pickup roller 2.

The manual feeding unit 500 feeds the sheet S from a manual feed tray 10, which is a unit for supporting the sheet S. The manual feeding unit 500 is an example of an opening and closing unit (i.e., door) and is provided to be able to open and close by rotating with respect to the apparatus main body 201A. The manual feed tray 10 can be moved between a closed position where it is stored in the apparatus main body 201A and an open position where it is opened from the apparatus main body 201A and is provided detachably from the apparatus main body 201A as described below. The manual feed tray 10 is an example of a support unit and supports the sheet S at the open position of the manual feeding unit 500.

The feeding unit 507 includes a pickup roller 502 that feeds the sheet S supported by the manual feed tray 10 and a separating roller pair that separates the sheet S fed by the pickup roller 502. The separating roller pair is made up of a feeding roller 503 and a delay roller 504 (see FIG. 3). The sheets S separated one by one by the separating roller pair are conveyed to a registration roller pair 240 by a conveyance roller pair 506. In other words, the feeding unit 507 feeds the sheet S supported by the manual feed tray 10 to the conveyance roller pair 506. According to the present exemplary embodiment, the conveyance roller pair 506 is an example of a sheet conveyance unit that conveys a sheet and is stored in the apparatus main body 201A.

The image forming unit 201B forms an image on the sheet S conveyed from the cassette feeding unit 230 or the manual feeding unit 500. In other words, the image forming unit 201B forms an image on the sheet S conveyed by the conveyance roller pair 506. The image forming unit 201B is a four-drum full-color type and includes a laser scanner 210 and four process cartridges 211 (PY, PM, PC, and PK) that form toner images in four colors, yellow (Y), magenta (M), cyan (C), and black (K). Each of the process cartridges 211 includes a photosensitive drum 212, a charging device 213 as a charging unit, and a developing device 214 as a developing unit. The image forming unit 201B includes a secondary transfer unit 218 disposed above the process cartridge 211 and a fixing unit 201E. A toner cartridge 215 supplies toner to the developing device 214.

The secondary transfer unit 218 includes a transfer belt 216 that is wound around a drive roller 216*a* and a tension roller 216*b*. Primary transfer rollers 219 that come into contact with the transfer belt 216 at positions facing the photosensitive drums 212 of the respective colors are provided on an inner side of the transfer belt 216. The transfer belt 216 is rotated in a direction of an arrow by the drive roller 216*a*, which is driven by a drive unit. A secondary transfer roller 217 that transfers a color image formed on the transfer belt 216 to the sheet S is provided at a position facing the drive roller 216*a* of the secondary transfer unit 218.

The fixing unit 201E is disposed above the secondary transfer roller 217, and a first discharge roller pair 225*a* and a second discharge roller pair 225*b* that discharge the sheet S and a double-sided reversing unit 201F that inverts and conveys the sheet S are disposed above the fixing unit 201E. The double-sided reversing unit 201F includes a reversing roller pair 222 that can rotate forward and backward and a re-conveying path R through which the sheet S with an image formed on one side is conveyed again to the image forming unit 201B. The operation unit 730 that receives an operation from a user is provided on an upper portion of the image forming apparatus 1. The operation unit 730 adopts a touch panel method that has a display function and an input function.

An image forming operation of the image forming apparatus 1 is described. In a case where the image forming apparatus 1 receives image data of a document to be printed, the image information is subjected to image processing, converted into an electrical signal, and transmitted to the laser scanner 210 of the image forming unit 201B. In the image forming unit 201B, a surface of the photosensitive drum 212, which is uniformly charged to a predetermined polarity and potential by the charging device 213, is sequentially exposed with a laser. Accordingly, electrostatic latent images of yellow, magenta, cyan, and black are sequentially forms on the photosensitive drums of the respective process cartridges 211 (PY, PM, PC, and PK).

Subsequently, the electrostatic latent images are developed with toner of the respective colors and visualized, and the toner images of the respective colors on the respective photosensitive drums are sequentially superimposed on one another and transferred onto the transfer belt 216 by a primary transfer bias applied to the primary transfer roller 219. Accordingly, the toner images are formed on the transfer belt 216.

In parallel with the toner image forming operation, the sheet S is conveyed one by one to the registration roller pair 240 by the cassette feeding unit 230 or the manual feeding unit 500. The registration roller pair 240 controls timing of conveying the sheet S to the secondary transfer unit 218. A leading edge of the sheet S is brought into contact with a nip portion of the registration roller pair 240 so that the sheet S bends. Accordingly, skew feeding of the sheet S is corrected. After skew feeding of the sheet S is corrected, the sheet S is conveyed by the registration roller pair 240 to the secondary transfer unit 218, and the toner images are transferred to the sheet S all at once by a secondary transfer bias applied to the secondary transfer roller 217 in the secondary transfer unit 218.

The sheet S on which the toner images are transferred is conveyed to the fixing unit 201E, and the toner images of the respective colors are melt and mixed by heat and pressure in a roller nip portion formed by a pressing roller 220*a* and a heating roller 220*b* and fixed to the sheet S as a color image. The sheet S on which the image is fixed is discharged to the discharge space V by the first discharge roller pair 225*a* or the second discharge roller pair 225*b* disposed downstream of the fixing unit 201E and stacked on a discharge tray 223 protruding on a bottom surface of the discharge space V. In a case where images are formed on both sides of the sheet S, after the image is fixed, the sheet S is conveyed to the re-conveying path R by the reversing roller pair 222 and conveyed again to the image forming unit 201B.

[Manual Feeding Unit]

Figure 2:
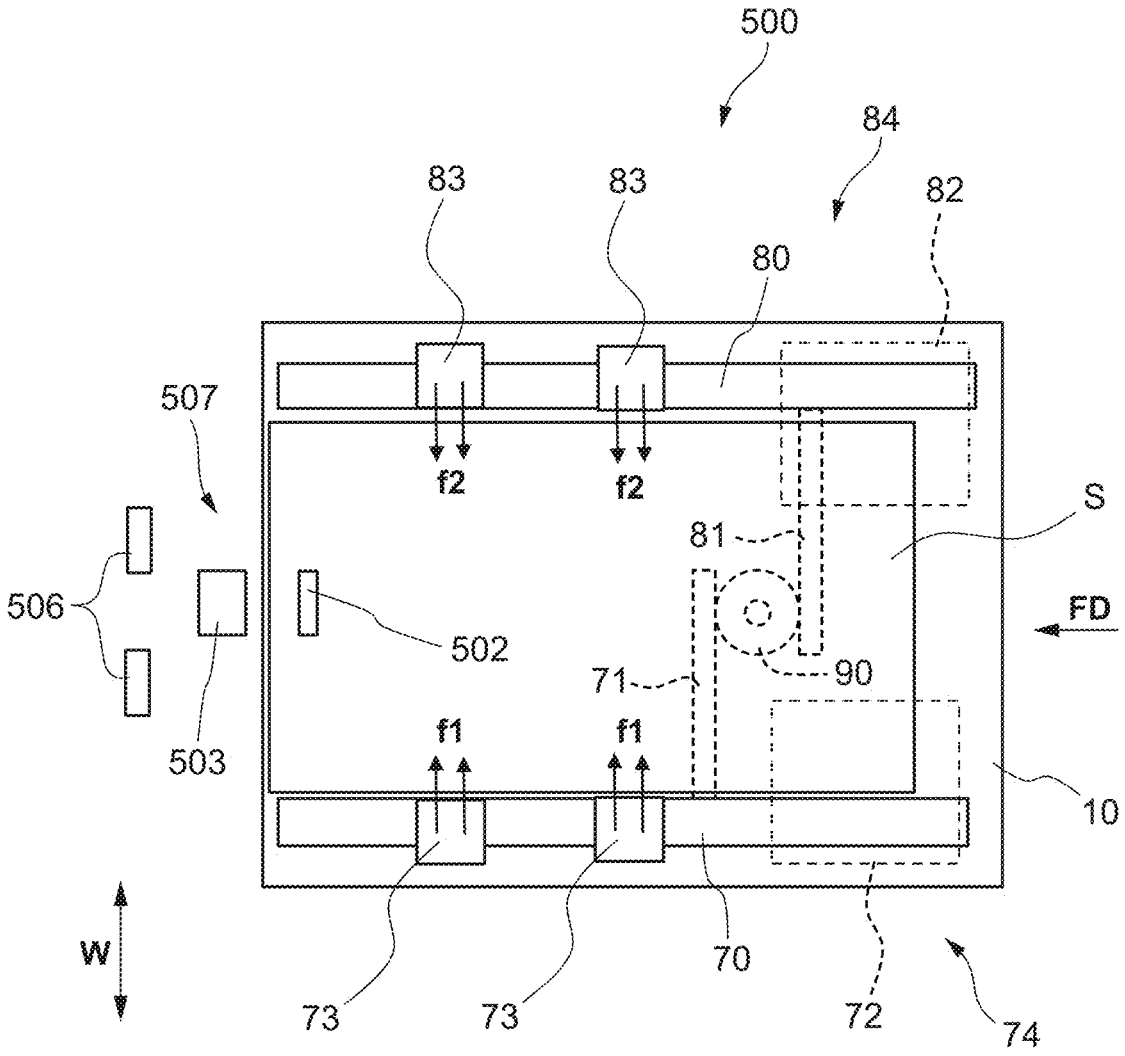
FIG. 2 is a plan view illustrating a state in which a manual feed tray is placed at an open position according to the exemplary embodiment.
Figure 4:
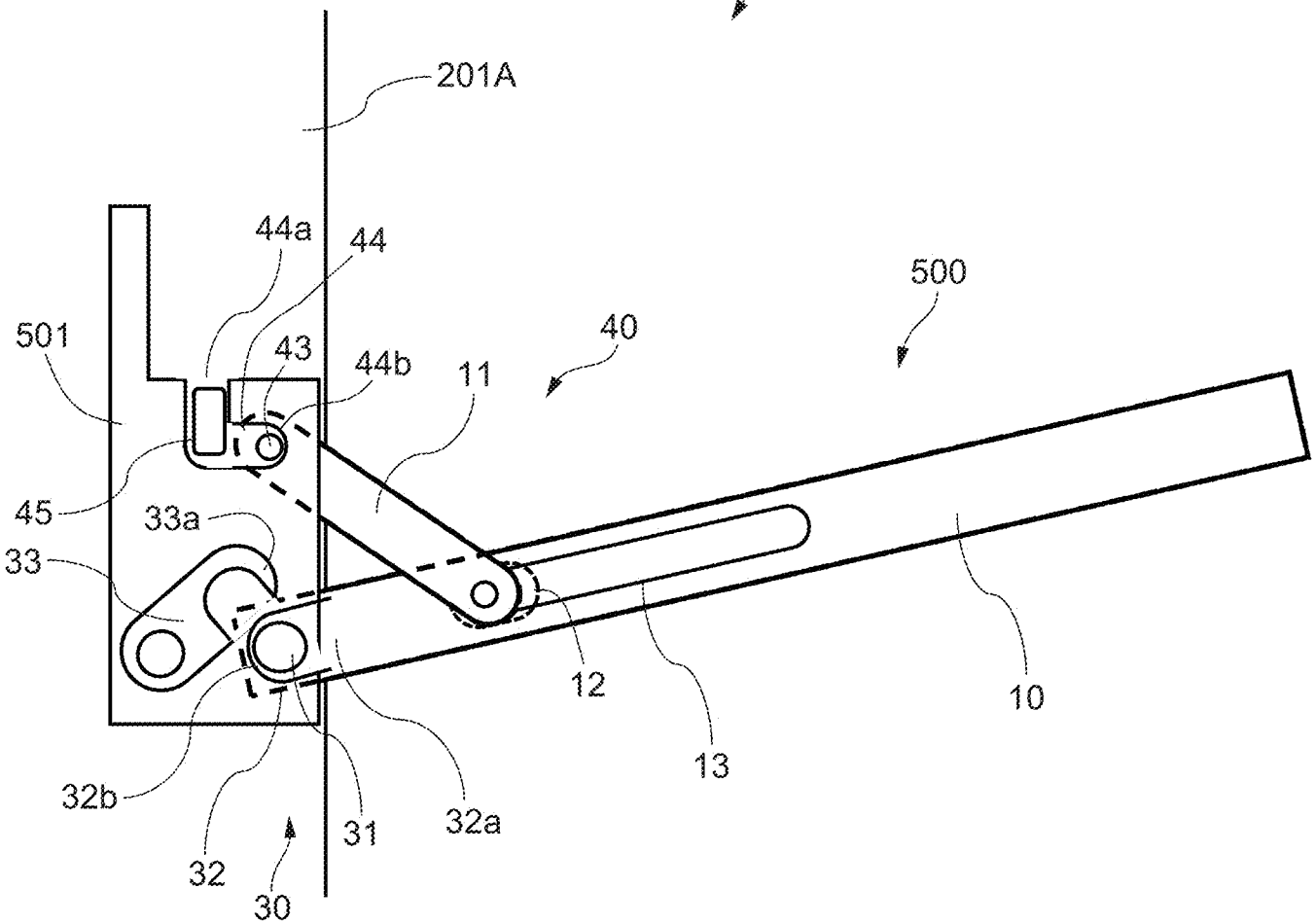
FIG. 4 is a front view illustrating a state in which the manual feed tray is placed at the open position and a tray attachment portion according to the exemplary embodiment.

The manual feeding unit 500 is described with reference to FIG. 2. As illustrated in FIG. 2, the manual feeding unit 500 includes the manual feed tray 10, the pickup roller 502, a first side regulating unit 70, and a second side regulating unit 80. As illustrated in FIG. 4, the image forming apparatus 1 includes a rotation mechanism 30 and a regulating unit (regulator) 40. The rotation mechanism 30 supports the manual feed tray 10 to be rotatable and detachable with respect to the apparatus main body 201A. The regulating unit 40 regulates the manual feed tray 10 from rotating in a direction in which the manual feed tray 10 opens wider than a case where the manual feed tray 10 is at the open position. Accordingly, the manual feed tray 10 is disposed on a side surface of the apparatus main body 201A so as to be able to open and close by rotating and is held to be movable from a storage position (closed position) at which the manual feed tray 10 is stored in the side surface of the apparatus main body 201A to a feeding position (open position) at which the sheet S can be stacked by opening the manual feed tray 10. A case where the manual feed tray 10 is in the open position is described below.

The pickup roller 502 feeds the sheet S placed on the manual feed tray 10. A pair of the first side regulating unit 70 and the second side regulating unit 80 are arranged on both sides of the sheet S placed on the manual feed tray 10 in a width direction W intersecting with a feeding direction FD and regulate a position of the sheet S in the width direction W. The first side regulating unit 70, for example, is disposed to be movable in the width direction W in the manual feed tray 10, and regulates the position of the sheet S supported by the manual feed tray 10 in the width direction W. The second side regulating unit 80 is disposed to be movable in the width direction W in conjunction with the first side regulating unit 70 and comes into contact with another end portion of the sheet S placed on the manual feed tray 10 in the width direction W. According to the present exemplary embodiment, the width direction W is a direction perpendicular to the feeding direction FD of the sheet S.

The first side regulating unit 70 includes a rack 71. Similarly, the second side regulating unit 80 includes a rack 81. Each of the racks 71 and 81 engages with a pinion gear 90 to interlock with each other. Accordingly, the first side regulating unit 70 and the second side regulating unit 80 both can move in synchronization with each other in the width direction W of the sheet S. One of the first side regulating unit 70 and the second side regulating unit 80 may be fixed so as not to move. Only the first side regulating unit 70 may be movably provided, and the second side regulating unit 80 may not be provided.

The first side regulating unit 70 is provided with a first air separation unit 74 including a fan motor 72 and blowing nozzles 73. Air f1 is blown out from the blowing nozzles 73 by driving of the fan motor 72 and is blown against a side surface of a sheet bundle placed on the manual feed tray 10. The air f1 from the fan motor 72 is blown to a side end portion of the sheet S as separation air, so that upper sheets S in the sheet bundle are raised, and an adhesion force between the sheets is reduced. In other words, the first air separation unit 74 is an example of an air separation unit and blows air to the bundle of the sheets S supported by the manual feed tray 10 in the width direction W from the first side regulating unit 70 to separate the sheets S.

Similarly, the second side regulating unit 80 is provided with a second air separation unit 84 including a fan motor 82 and blowing nozzles 83. Air f2 is blown out from the blowing nozzles 83 by driving of the fan motor 82 and is blown against the side surface of the sheet bundle placed on the manual feed tray 10 opposite to the first side regulating unit 70. The air f2 from the fan motor 82 is blown against the side end portion of the sheet S as separation air, so that the upper sheet S in the sheet bundle is effectively raised and the adhesion force between the sheets is reduced in combination with the air f1 blown from the opposite side. Each of the racks 71 and 81, the pinion gear 90, and each of the fan motors 72 and 82 are provided on the opposite sides of the sheet placed on the manual feed tray 10 with respect to a sheet stacking surface thereof.

If a user selects the manual feeding unit 500 and executes an operation of starting image formation, sheet feeding is started from the manual feeding unit 500. In a case where the sheet S placed on the manual feed tray 10 is, for example, coated paper, the fan motors 72 and 82 are operated. Accordingly, the air f1 and f2 is blown from the blowing nozzles 73 and 83 to the end portions of the sheet bundle in the width direction W.

Figure 3:
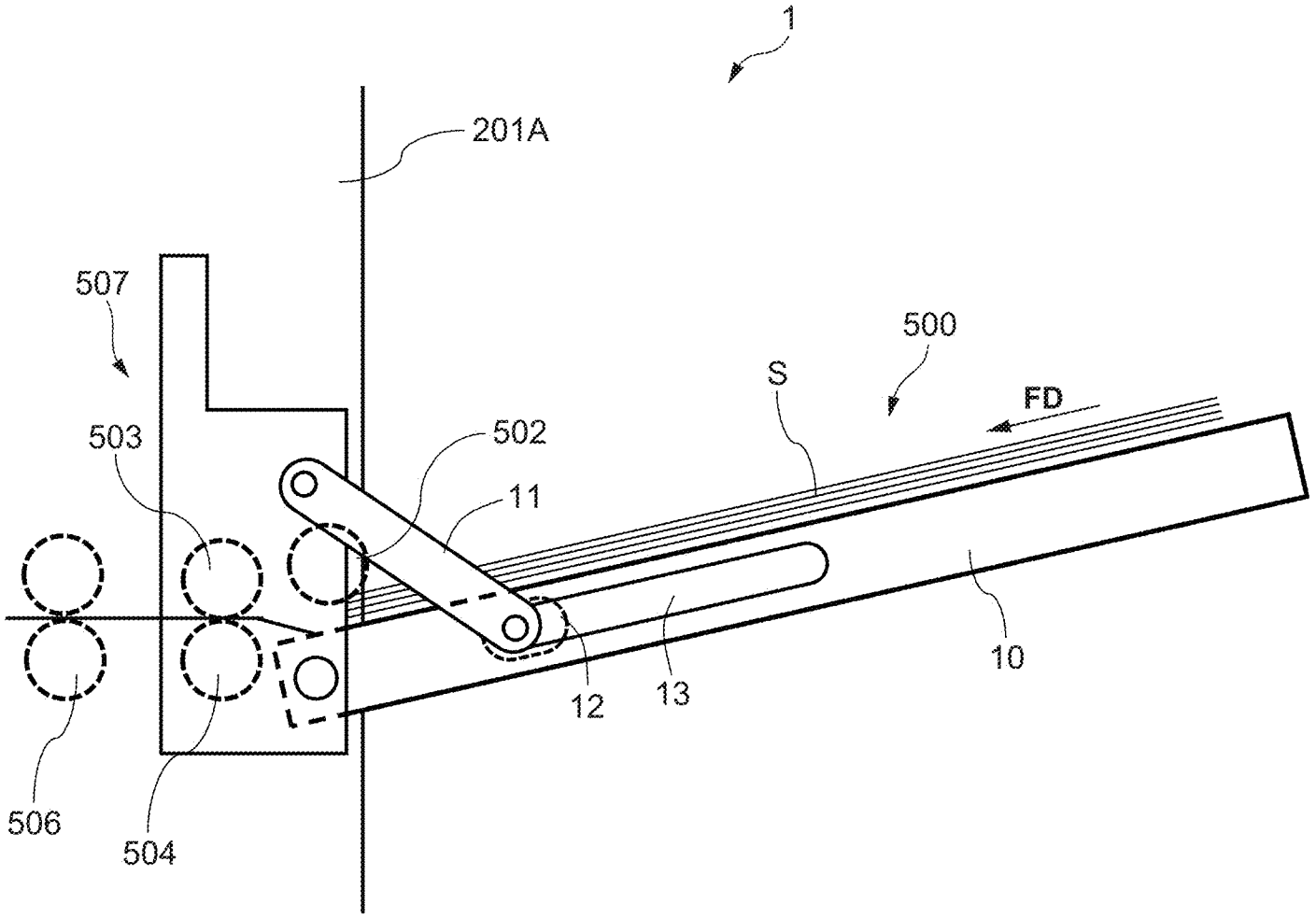
FIG. 3 is a front view illustrating a state in which the manual feed tray is placed at the open position according to the exemplary embodiment.

After a predetermined time has passed since the start of blowing the air f1 and f2, an uppermost sheet S in a state in which the adhesion force between the sheets is reduced is fed by a rotating pickup roller 502 and conveyed to the separating roller pair made up of the feeding roller 503 and the delay roller 504. The sheet S separated from the sheet bundle by the separating roller pair is conveyed to the registration roller pair 240 by the conveyance roller pair 506. In FIG. 3 and subsequent drawings, the first side regulating unit 70 and the second side regulating unit 80 are omitted from illustration. According to the present exemplary embodiment, a case where the manual feeding unit 500 includes the first air separation unit 74 and the second air separation unit 84 is described, but the present disclosure is not limited to this configuration and may not include these units.

[Rotation Mechanism of Manual Feed Tray]

A configuration for supporting the manual feed tray 10 according to the present exemplary embodiment is described in detail with reference to FIGS. 3 to 7. FIG. 3 is a front view illustrating the manual feed tray 10 according to the present exemplary embodiment placed at the open position. FIG. 4 is a front view illustrating a configuration in which the sheet S and the feeding unit 507 in FIG. 3 are omitted. The manual feed tray 10 is rotatably provided on the side surface of the apparatus main body 201A and is opened from the storage position at which the manual feed tray 10 is stored in the side surface of the apparatus main body 201A to the feeding position where the sheet S can be stacked.

The rotation mechanism 30 that rotates the manual feed tray 10 with respect to the apparatus main body 201A includes a rotating shaft 31, a first groove portion 32, and a first lock unit 33.

The rotating shaft 31 is attached to a side surface of the manual feed tray 10 and serves as a rotation center (axis) for the manual feed tray 10 to rotate. According to the present exemplary embodiment, the rotating shaft 31 has a circular cross section. The first groove portion 32 is formed in a support member 501 attached to the apparatus main body 201A. The first groove portion 32 includes an opening portion 32*a* that has a width greater than or equal to a maximum diameter of the rotating shaft 31 and opens in a direction perpendicular to a shaft direction of the rotating shaft 31 and a support surface 32*b* at an innermost portion thereof. The rotating shaft 31 is detachably engaged with and supported by the first groove portion 32 via the opening portion 32*a*, thereby enabling the manual feed tray 10 to rotate.

As a configuration that prevents the rotating shaft 31 from easily coming off the first groove portion 32, for example, a cross-sectional shape of the rotating shaft 31 may be D-cut or double D-cut, and the opening portion 32*a* may be made smaller than the maximum diameter of the rotating shaft 31. In this case, if the rotating shaft 31 is inserted into or removed from the first groove portion 32, the rotating shaft 31 passes through the opening portion 32*a* at an angle at which a diameter of the rotating shaft 31 is smaller than the maximum diameter. During normal use (when rotating between the storage position and a sheet feeding position), the rotating shaft 31 is set to an angle at which the diameter of the rotating shaft 31 is the maximum diameter so as not to come out of the opening portion 32*a*. However, with this configuration, if the rotating shaft 31 is inserted into or removed from the first groove portion 32, it is necessary to match a rotation phase of the D-cut of the rotating shaft 31 with a phase of the first groove portion 32. In other words, a user must open the manual feed tray 10 wider than a case where the manual feed tray 10 is at the sheet feeding position and match the phases to perform operation so that a portion where the diameter of the rotating shaft 31 is smaller than the maximum diameter passes through the opening portion 32*a*. Particularly, in a case where a large or heavy manual feed tray 10 is inserted or removed, such phase matching reduces workability and is not desirable. In contrast, according to the present exemplary embodiment, the opening portion 32*a* has the width greater than or equal to the maximum diameter of the rotating shaft 31, so that the manual feed tray 10 can be inserted or removed at an arbitrary angle even if the rotating shaft 31 has a circular cross section or a double D-cut shape, thereby improving workability.

Figure 5:
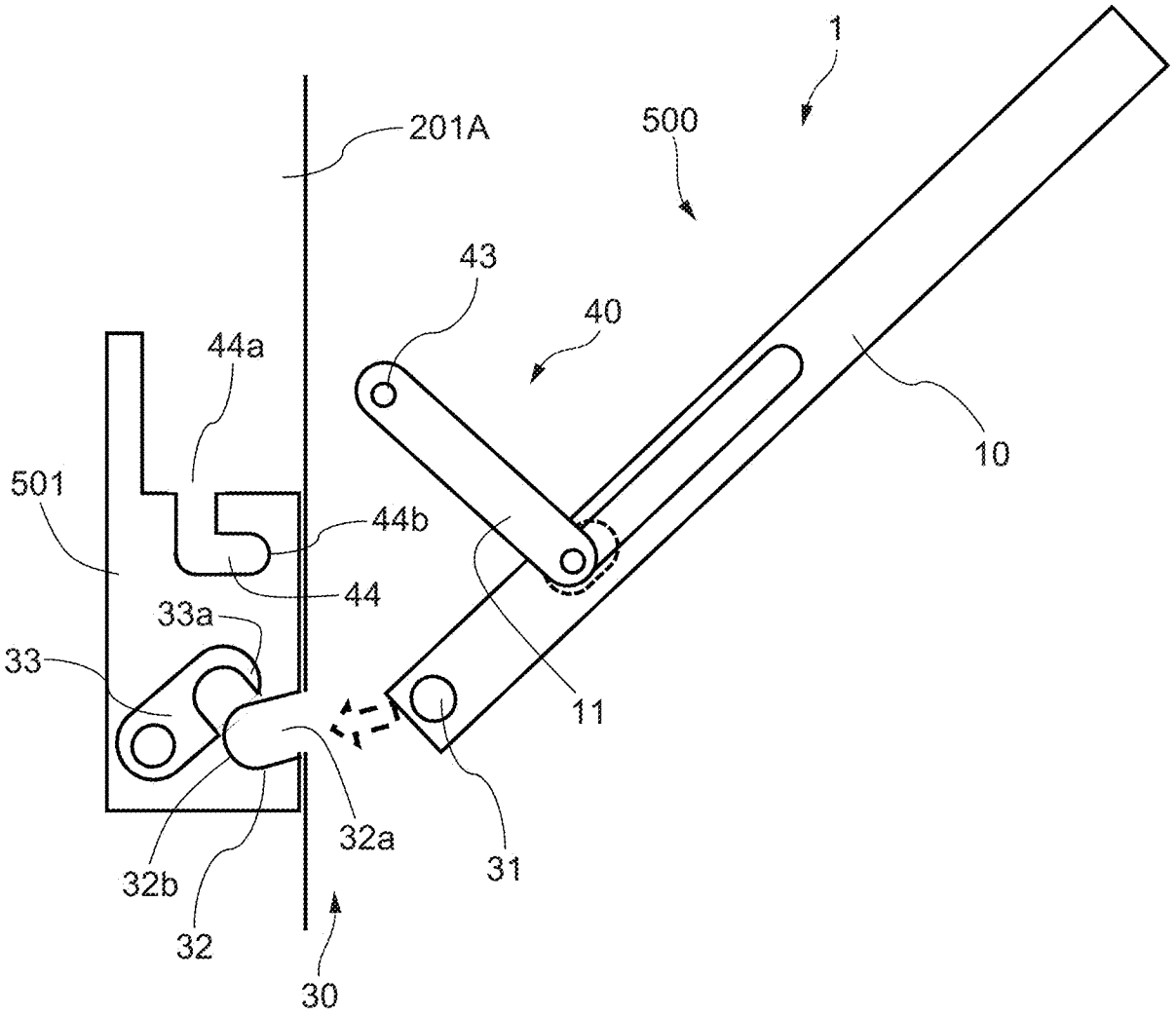
FIG. 5 is a front view illustrating a state in which the manual feed tray is separated from an apparatus main body according to the exemplary embodiment.

According to the present exemplary embodiment, the opening portion 32*a* opens in a direction in which the manual feeding unit 500 is provided in the apparatus main body 201A as illustrated in FIG. 5. In other words, the opening portion 32*a*, which is an open portion of the first groove portion 32, is provided on a side where the manual feed tray 10 is opened from the support surface 32*b*. The first groove portion 32 is formed to guide the rotating shaft 31 in a direction along the feeding direction FD (see FIG. 3) of the sheet S by the feeding unit 507 if the manual feed tray 10 is placed at the open position. In this way, the manual feed tray 10 is rotatably supported with respect to the apparatus main body 201A by the rotating shaft 31 and the support surface 32*b* of the first groove portion 32.

FIG. 4 illustrates a state in which the manual feed tray 10 is placed at the open position and the first lock unit 33 is disengaged from the rotating shaft 31. The first lock unit 33 is provided movably as a separate member separated from the first groove portion 32 and the rotating shaft 31 and can switch between a first locked state in which the rotating shaft 31 is locked to be engaged with the first groove portion 32 and a first released state in which the first locked state is released. In other words, the first lock unit 33 is not configured to elastically move relative to the first groove portion 32 and the rotating shaft 31, but may move by rotation without elastic deformation.

Figure 6:
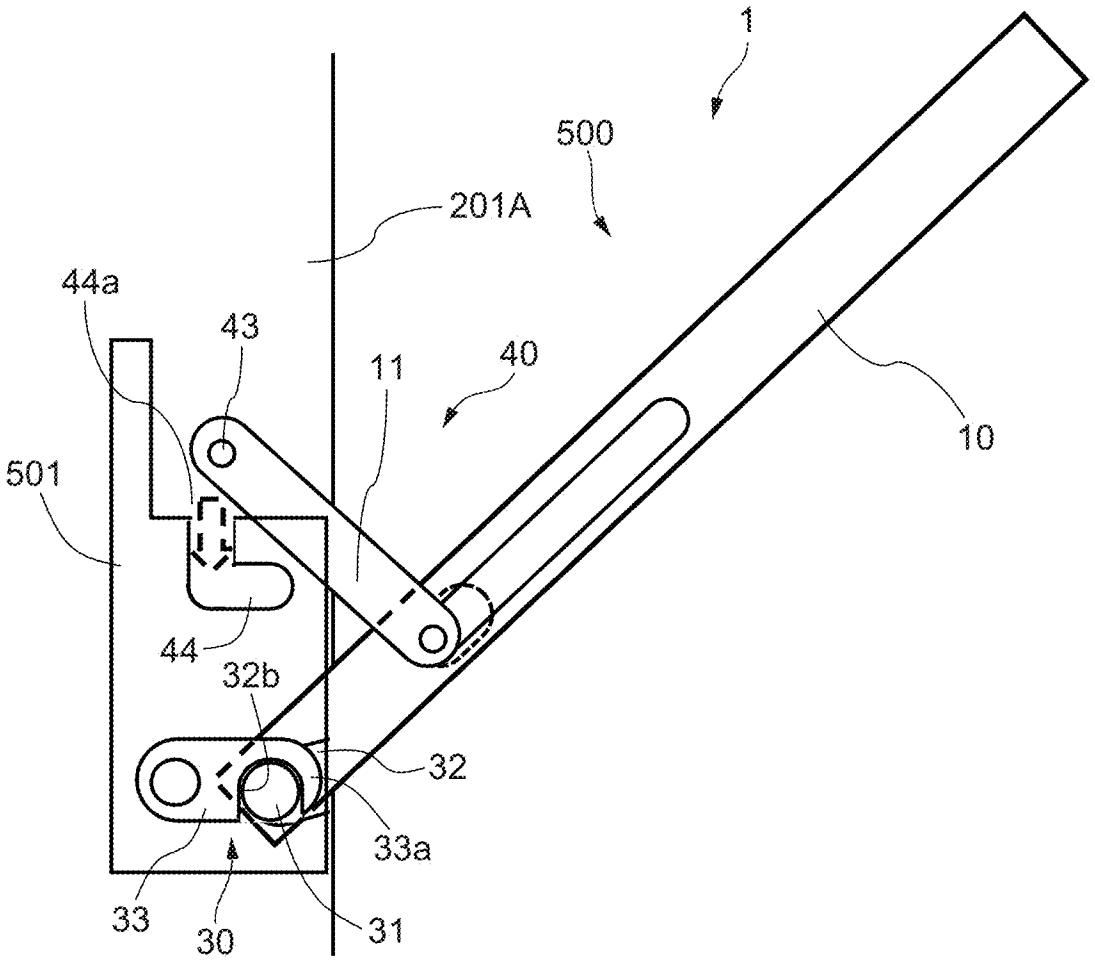
FIG. 6 is a front view illustrating a state in which a rotating shaft of the manual feed tray is attached to a first groove portion and a swing shaft of the manual feed tray is separated from a second groove portion according to the exemplary embodiment.
Figure 7:
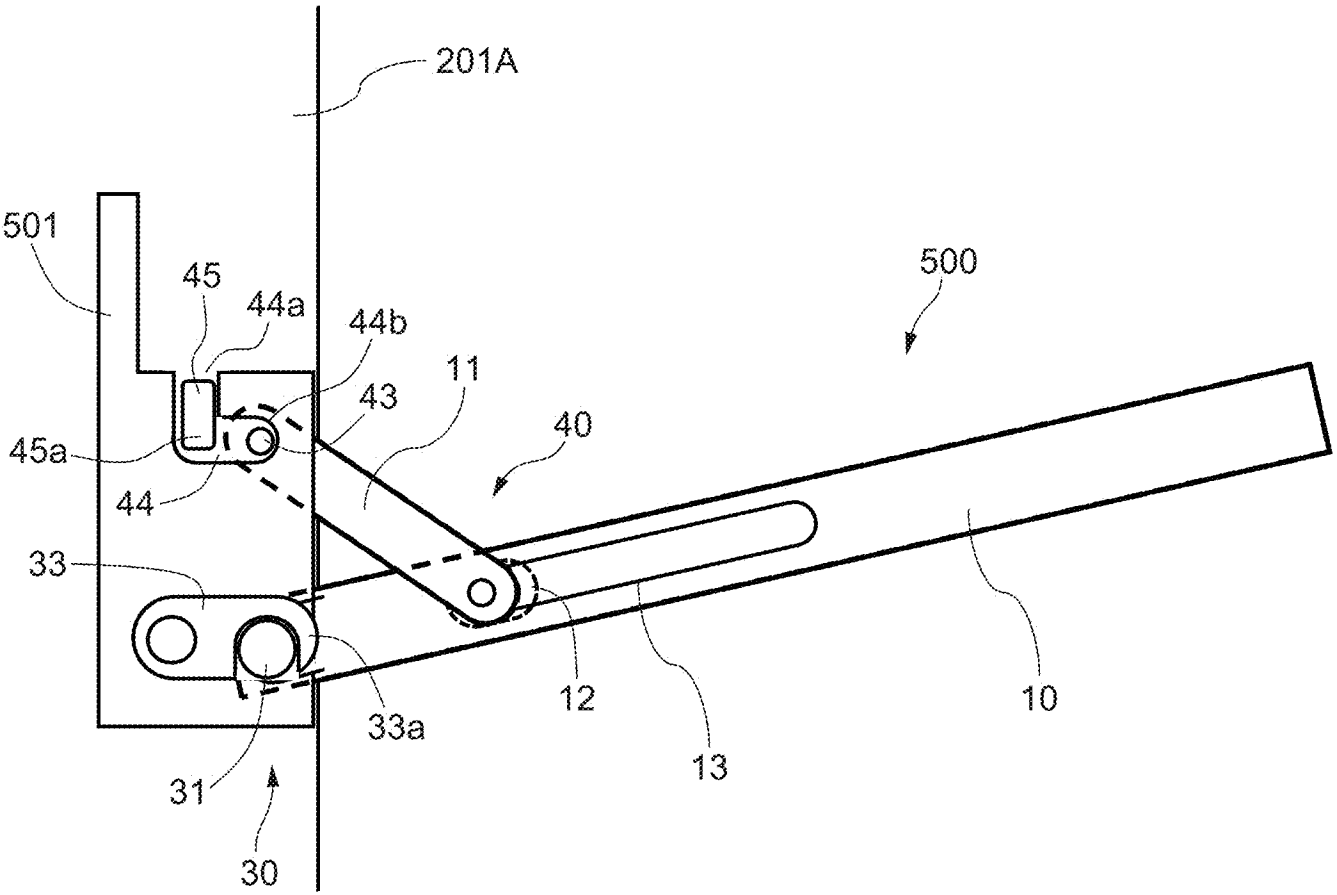
FIG. 7 is a front view illustrating a state in which the manual feed tray is attached to the apparatus main body according to the exemplary embodiment.

The first locked state is, for example, a state illustrated in FIGS. 6 and 7, and the first released state is, for example, a state illustrated in FIGS. 4 and 5. The first lock unit 33 may rotatably fit in the first groove portion 32 and includes a rotating shaft regulating unit 33*a* that can engage with the rotating shaft 31. The rotating shaft regulating unit 33*a* regulates the rotating shaft 31 from moving in a direction away from the first groove portion 32 in the first locked state and allows the rotating shaft 31 to move in the direction away from the first groove portion 32 in the first released state. In other words, the first lock unit 33 is formed in a hook shape that can lock the rotating shaft regulating unit 33*a* to the rotating shaft 31.

The first lock unit 33 includes a concave portion that overlaps with the first groove portion 32 in a direction substantially perpendicular to a center line of the first groove portion 32, and the rotating shaft 31 is configured to fit into the concave portion. Accordingly, a movement of the rotating shaft 31 is regulated by the first groove portion 32 in a substantially vertical direction perpendicular to the feeding direction FD and regulated by the support surface 32*b* or the concave portion of the first lock unit 33 in the feeding direction FD. According to the present exemplary embodiment, the first lock unit 33 is described as being formed in a rotatable hook shape, but it is not limited to this shape and may be configured, for example, to slot into the first groove portion 32 to prevent the rotating shaft 31 from coming off.

[Regulating Unit of Manual Feed Tray]

The regulating unit 40 includes a support arm 11, a swing shaft 43 attached to the support arm 11, and a second groove portion 44 formed in the apparatus main body 201A and is configured to regulate the manual feed tray 10 from rotating in a direction in which the manual feed tray 10 opens wider than a case where the manual feed tray 10 opens at the open position. The support arm 11 regulates the position of the manual feed tray 10 when it is opened. One end portion of the support arm 11 is rotatably supported by the apparatus main body 201A, and the other end portion is rotatably connected to a first moving member 12 on the side surface of the manual feed tray 10. The first moving member 12 can move in both upstream and downstream directions in the feeding direction FD on a tray rail 13 provided inside the manual feed tray 10. The tray rail 13 is an example of a guiding unit and includes an opening portion formed on a frame of the manual feed tray 10 with the feeding direction FD as a longitudinal direction. According to the present exemplary embodiment, the support arm 11 and the tray rail 13 are disposed on both end portions in the width direction W. However, they are not limited to being disposed on both end portions and may be disposed on only one end portion.

The support arm 11 is an example of a swing member, one end portion of which is swingably supported by the apparatus main body 201A, and the other end portion of which is engaged with the manual feeding unit 500. The first moving member 12 is an example of a guided unit and moves by being guided by the tray rail 13 as the manual feeding unit 500 rotates. The support arm 11 includes the first moving member 12 at the other end portion. The support arm 11 receives a load of the manual feeding unit 500 between it and the tray rail 13 if the manual feeding unit 500 is placed at the open position. According to the present exemplary embodiment, one end portion of the support arm 11 is provided swingably relative to the apparatus main body 201A, but the support arm 11 may be swingably supported at a position other than the end portion without being limited to the end portion. Similarly, the other end portion of the support arm 11 is connected to the first moving member 12, but the support arm 11 may be connected to a position other than the end portion without being limited to the end portion. According to the present exemplary embodiment, a case is described where the first moving member 12, which is a guided unit, is a member separate from the support arm 11, but the guided unit may be formed of the same member as the support arm 11 without being limited to this case.

The swing shaft 43 is attached to the support arm 11 and serves as a swing center of the support arm 11 in swinging. The second groove portion 44 is formed in the apparatus main body 201A and supports the swing shaft 43 that is detachably engaged therewith, so that the support arm 11 is swingable.

According to the present exemplary embodiment, the second groove portion 44 has a width greater than or equal to the maximum diameter of the swing shaft 43 and includes an opening portion 44*a* that opens in a direction perpendicular to a shaft direction of the swing shaft 43 and a support surface 44*b* at an innermost portion thereof.

The opening portion 44*a* opens upward. The second groove portion 44 extends downward from the opening portion 44*a*, and bends horizontally in a direction in which the manual feeding unit 500 is provided, to form into a substantially L-shape overall. In other words, the opening portion 44*a*, which is an open portion of the second groove portion 44, is provided closer to the apparatus main body 201A than the support surface 44*b*. Accordingly, if the rotating shaft 31 is engaged with the first groove portion 32 and then the swing shaft 43 is engaged with the second groove portion 44, the swing shaft 43 is inserted into the opening portion 44*a* and pulled in the horizontal direction toward the manual feeding unit 500, thereby realizing a stable support that may not be easily removed.

According to the present exemplary embodiment, a second lock unit 45 is movably provided on the apparatus main body 201A with respect to the second groove portion 44 and the swing shaft 43. The second lock unit 45 is configured, for example, to slot into the second groove portion 44 downward from the opening portion 44*a*. According to the present exemplary embodiment, the second lock unit 45 is provided as a separate member separated from the second groove portion 44 and the swing shaft 43 and is not moved elastically relative to the second groove portion 44 and the swing shaft 43 but is moved by reciprocating motion in the vertical direction without elastic deformation. However, the second lock unit 45 is not limited to the configuration of the reciprocating motion in the vertical direction and may include, for example, a configuration that the second lock unit 45 protrudes from and retracts to the second groove portion 44 from the width direction W and a configuration that the second lock unit 45 locks the swing shaft 43 by rotating, akin to operation of the first lock unit 33.

The second lock unit 45 can switch between a second locked state in which the swing shaft 43 is locked to be supported by the second groove portion 44 and a second released state in which the second locked state is released.

A distal portion of the second lock unit 45 may act as a swing shaft regulating unit 45*a* to regulate insertion into and removal of the swing shaft 43 into/from the second groove portion 44. The swing shaft regulating unit 45*a* regulates the swing shaft 43 from moving in a direction away from the second groove portion 44 in the second locked state and allows the swing shaft 43 to move in the direction away from the second groove portion 44 in the second released state.

An operation of attaching the manual feed tray 10 is described with reference to FIGS. 5 to 7. FIG. 5 illustrates a state in which the manual feed tray 10 is separated from the apparatus main body 201A. FIG. 6 illustrates a state in which the rotating shaft 31 is engaged with the first groove portion 32. FIG. 7 illustrates a state in which the rotating shaft 31 is attached to the first groove portion 32, and then the swing shaft 43 is attached to the second groove portion 44. An operation of separating the manual feed tray 10 can be performed by reversing the attaching operation, so that a description thereof is omitted.

As a procedure, the rotating shaft 31 is inserted into the opening portion 32*a* of the first groove portion 32 as illustrated in FIG. 5. As illustrated in FIG. 6, the rotating shaft 31 is inserted so as to come into contact with the support surface 32*b* of the first groove portion 32 and then is rotatably locked by the first lock unit 33 in the first groove portion 32. An upper end of the support arm 11 is moved downward, and the swing shaft 43 is inserted downward from the opening portion 44*a* of the second groove portion 44. As illustrated in FIG. 7, the swing shaft 43 is inserted so as to come into contact with the support surface 44*b* of the second groove portion 44 and then is locked by the second lock unit 45 to be swingable in the second groove portion 44.

As described above, in the manual feeding unit 500 according to the present exemplary embodiment, the rotation mechanism 30 includes the rotating shaft 31, the first groove portion 32, and the first lock unit 33, and the first lock unit 33 is provided movably as a separate member separated from the first groove portion 32 and the rotating shaft 31. Thus, in a case where the manual feed tray 10 is separated from the apparatus main body 201A, it is only necessary to rotate the first lock unit 33, and this operation can be easily performed with a small force. Accordingly, the force required to separate the manual feed tray 10 can be made smaller compared with a case where the manual feed tray 10 is locked using a snap fit mechanism that involves elastic deformation, so that workability at the time of attaching and separating the manual feeding unit 500 can be improved.

According to the present exemplary embodiment, the opening portion 32*a* of the first groove portion 32 has the width greater than or equal to the maximum diameter of the rotating shaft 31, so that the rotating shaft 31 can be inserted into and removed from the first groove portion 32 regardless of its angle even if the cross-sectional shape thereof is a double D-cut shape. Accordingly, the rotation phases need not be matched in the operations of attaching and separating the manual feed tray 10, and a change in a tray orientation during attachment or separation can be reduced. The opening portion 32*a* is not provided on the support surface 32*b* where a load due to a tray's own weight is applied to the support unit, so that the load is not released at a loaded portion on the support surface 32*b* due to the tray's own weight, and the manual feed tray 10 can be stably locked. Thus, the manual feed tray 10 can be attached to and separated from the apparatus main body 201A in a stable orientation during attachment or separation.

According to the present exemplary embodiment, the opening portion 32*a* opens in a direction in which the manual feeding unit 500 is provided in the apparatus main body 201A. The first groove portion 32 is formed to guide the rotating shaft 31 in a direction along the feeding direction FD in a case where the manual feed tray 10 is placed at the open position. Thus, a user can attach and separate the manual feed tray 10 to and from the apparatus main body 201A in a state in which the manual feed tray 10 is inclined to the same extent as in a case where the manual feed tray 10 is inclined at the open position, so that even with a heavy manual feed tray 10, workability can be improved.

According to the present exemplary embodiment, the opening portion 44*a* of the second groove portion 44 has the width greater than or equal to the maximum diameter of the swing shaft 43, so that the swing shaft 43 can be inserted into and removed from the second groove portion 44 regardless of its angle even if the cross-sectional shape thereof is a double D-cut shape. Accordingly, the rotation phases need not be matched in the operations of attaching and separating the manual feed tray 10, and a change in the tray orientation during attachment or separation can be reduced. The opening portion 44*a* is not provided on the support surface 44*b* where the load due to the tray's own weight is applied to the support unit, so that the load is not released at the loaded portion on the support surface 44*b* due to the tray's own weight, and the manual feed tray 10 can be stably locked. Thus, the manual feed tray 10 can be attached to and separated from the apparatus main body 201A in a stable orientation during attachment or separation.

According to the above-described exemplary embodiments, a case is described in which the support arm 11 is used as a regulating unit that regulates the manual feeding unit 500 from rotating in a direction in which the manual feeding unit 500 opens wider than a case where the manual feeding unit 500 opens at the open position, but the present disclosure is not limited to this configuration. For example, a stopper that comes into contact with the side of the manual feed tray 10 in the rotation direction may be provided on the apparatus main body 201A as a regulating unit, or a stopper that regulates the rotation of the rotating shaft 31 may be provided as a regulating unit.

Figure 8:
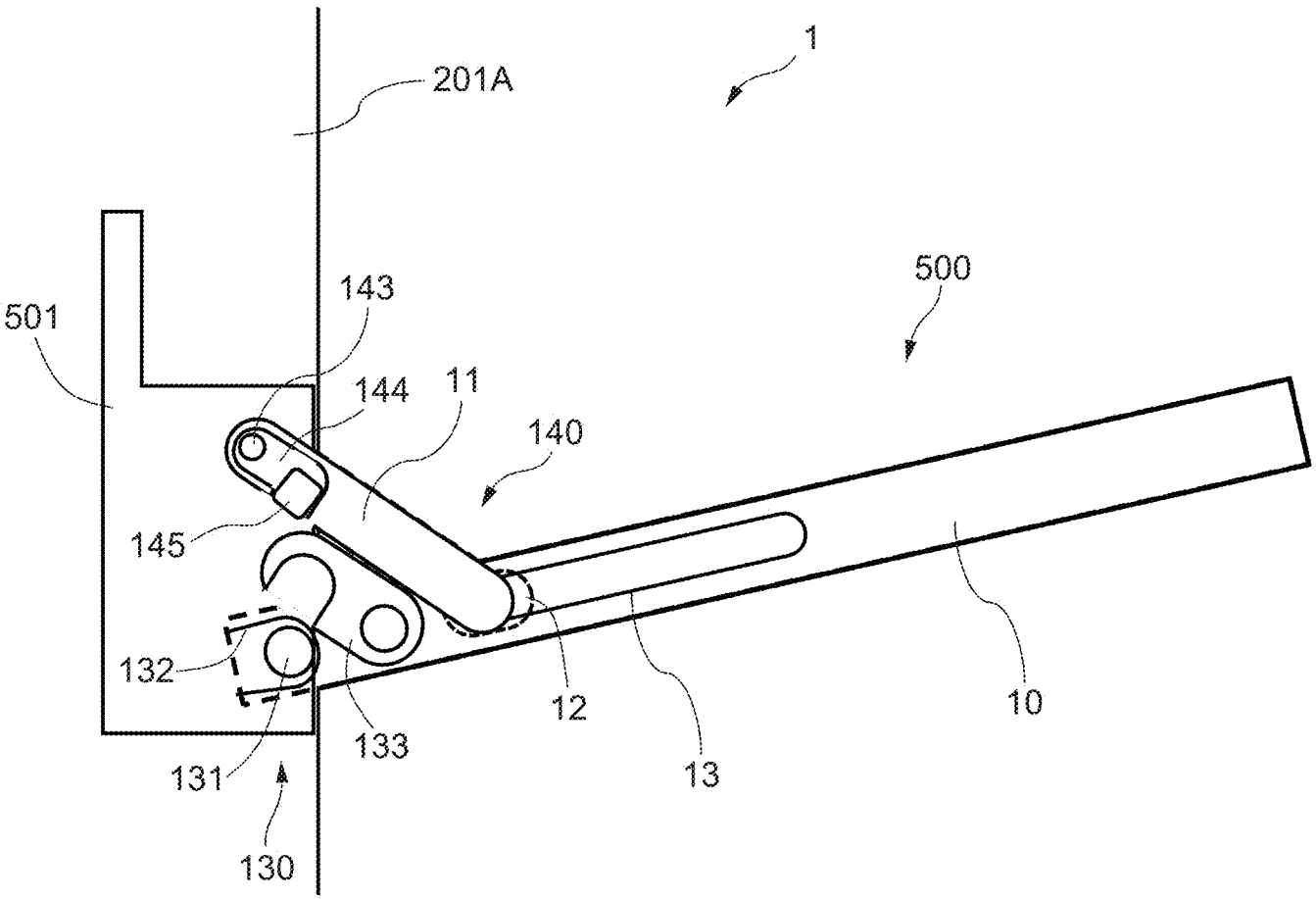
FIG. 8 is a front view illustrating a state in which a manual feed tray is placed at an open position and a first lock unit is released according to a modification.

According to the above-described exemplary embodiment, a case is described in which the rotating shaft 31 is attached to the manual feeding unit 500 and the first groove portion 32 is formed in the support member 501 attached to the apparatus main body 201A, but the present disclosure is not limited to this configuration. For example, as a rotation mechanism 130 illustrated in FIGS. 8 to 11, a rotating shaft 131 may be attached to the apparatus main body 201A, and a first groove portion 132 may be formed in the manual feeding unit 500. FIG. 8 illustrates a state in which the manual feeding unit 500 is placed at the open position and a first lock unit 133 is disengaged. In this case, the first lock unit 133 is rotatably attached to the manual feed tray 10. In other words, the rotating shafts 31 and 131 are attached to one of the manual feeding unit 500 and the apparatus main body 201A, and the first groove portions 32 and 132 are formed in the other of the manual feeding unit 500 and the apparatus main body 201A.

According to the above-described exemplary embodiment, a case is described in which the swing shaft 43 is attached to the support arm 11 and the second groove portion 44 is formed in the support member 501 attached to the apparatus main body 201A, but the present disclosure is not limited to this configuration. For example, as illustrated in FIGS. 8 to 11, a swing shaft 143 may be attached to the apparatus main body 201A and a second groove portion 144 may be formed in the support arm 11. In this case, a second lock unit 145 is movably attached to the support arm 11. In other words, the swing shafts 43 and 143 are attached to one of the support arm 11 and the apparatus main body 201A, and the second groove portions 44 and 144 are formed in the other of the support arm 11 and the apparatus main body 201A.

Figure 10:
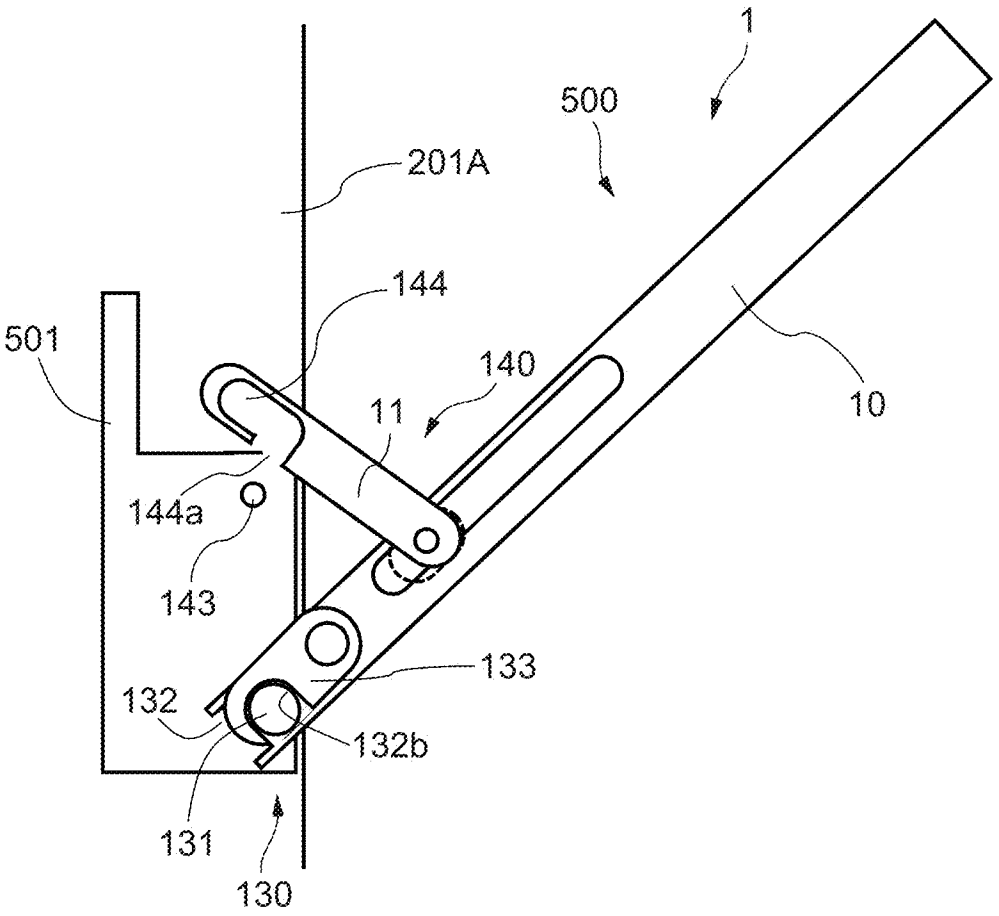
FIG. 10 is a front view illustrating a state in which a rotating shaft is attached to a first groove portion and a swing shaft is separated from a second groove portion according to the modification.
Figure 11:
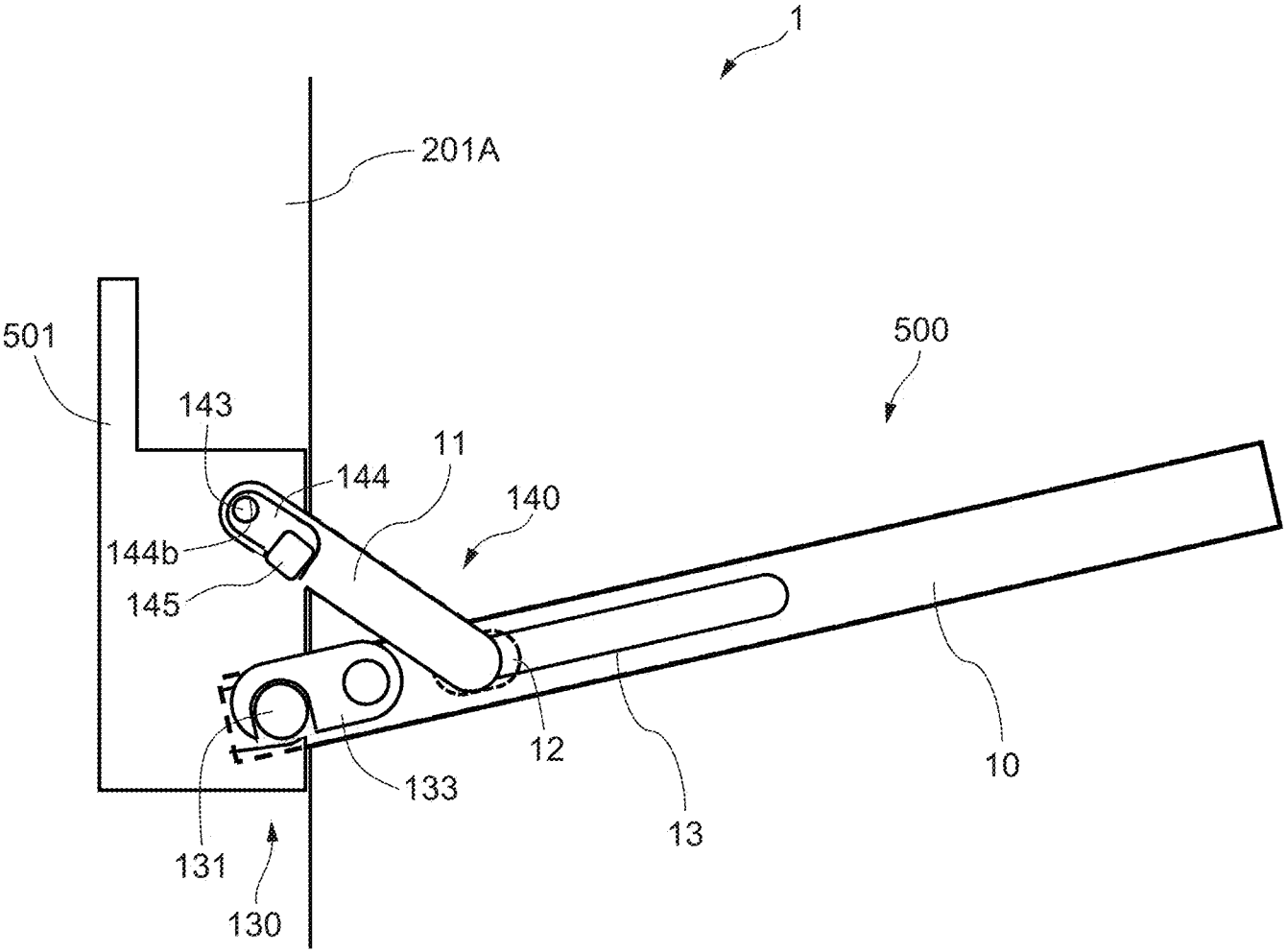
FIG. 11 is a front view illustrating a state in which the manual feed tray is attached to the apparatus main body according to the modification.

An operation of attaching the manual feed tray 10 in this case is described with reference to FIGS. 9 to 11.

Figure 9:
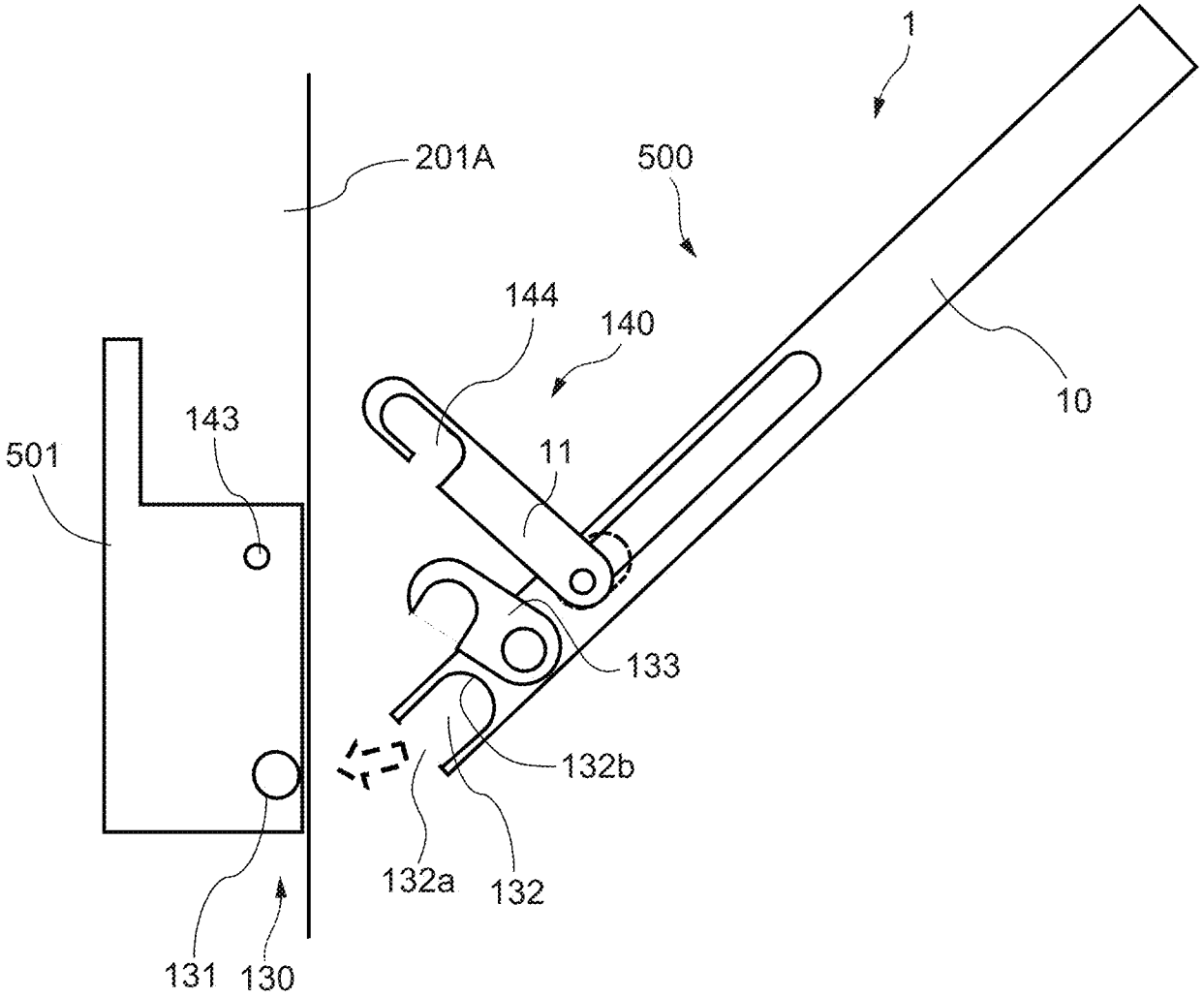
FIG. 9 is a front view illustrating a state in which the manual feed tray is separated from an apparatus main body according to the modification.

FIG. 9 illustrates a state in which the manual feeding unit 500 is separated from the apparatus main body 201A. FIG. 10 illustrates a state in which the rotating shaft 131 is attached to the first groove portion 132 and the swing shaft 143 is separated from the second groove portion 144. FIG. 11 illustrates a state in which the rotating shaft 131 is attached to the first groove portion 132 and then the swing shaft 143 is attached to the second groove portion 144. An operation of separating the manual feed tray 10 can be performed by reversing the attaching operation, so that a description thereof is omitted.

As a procedure, an opening portion 132*a* of the first groove portion 132 is engaged with the rotating shaft 131 as illustrated in FIG. 9. As illustrated in FIG. 10, a support surface 132*b* of the first groove portion 132 comes into contact with and engages with the rotating shaft 131, and then the rotating shaft 131 is rotatably locked by the first lock unit 133 in the first groove portion 132. The upper end of the support arm 11 is moved downward, and an opening portion 144*a* of the second groove portion 144 is engaged with the swing shaft 43. As illustrated in FIG. 11, a support surface 144*b* of the second groove portion 144 comes into contact with and engages with the swing shaft 143, and then the swing shaft 143 is swingably locked by the second groove portion 144 in the second lock unit 145.

The rotating shaft 31 and the first groove portion 32 may be respectively attached to the manual feeding unit 500 and the apparatus main body 201A, and the swing shaft 143 and the second groove portion 144 may be respectively formed in the apparatus main body 201A and the support arm 11. Alternatively, the rotating shaft 131 may be attached to the apparatus main body 201A and the first groove portion 132 may be formed in the manual feeding unit 500, and the swing shaft 43 may be attached to the support arm 11 and the second groove portion 44 may be formed in the apparatus main body 201A.

According to the above-described exemplary embodiments, a case where a sheet conveyance apparatus is the image forming apparatus 1 is described, but the present disclosure is not limited to this configuration. For example, a sheet conveyance apparatus may be applied to a sheet feeding apparatus that conveys a sheet without including the image forming unit 201B.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2023-165480, filed Sep. 27, 2023, which is hereby incorporated by reference herein in its entirety.

What is claimed is:

1. A sheet conveyance apparatus comprising:

a housing including a sheet conveyance unit;

an opening and closing unit configured to at least one of open and close by rotating with respect to the housing, to move between a closed position and an open position, the opening and closing unit including a support unit configured to support at least one sheet at the open position, wherein the opening and closing unit is detachably attached to the housing;

a feeding unit configured to feed a sheet of the at least one sheet supported by the support unit to the sheet conveyance unit;

at least one regulating unit configured to regulate the opening and closing unit in the open position;

a shaft attached to one of the opening and closing unit and the housing, configured to serve as an axis for rotation of the opening and closing unit;

a first groove portion that includes an opening extending in a direction perpendicular to the axis for detachably engaging the shaft; and a first lock unit configured to switch between engaging and releasing the shaft within/from the first groove portion.

2. The sheet conveyance apparatus according to claim 1, wherein the first lock unit includes a shaft regulating unit that is rotatably provided with respect to the first groove portion and is configured to maintain the shaft within the first groove portion.

3. The sheet conveyance apparatus according to claim 1, wherein the shaft is attached to the opening and closing unit, and wherein the first groove portion is formed in the housing and is configured to support the shaft.

4. The sheet conveyance apparatus according to claim 1, wherein the opening and closing unit is configured to attach to the housing in the direction of the opening of the first groove portion.

5. The sheet conveyance apparatus according to claim 1, wherein the first groove portion is configured to guide the shaft in a direction corresponding to a feeding direction in which the at least one sheet is fed by the feeding unit.

6. The sheet conveyance apparatus according to claim 1, wherein the at least one regulating unit includes:

a swing member with one end portion configured to be swingably and detachably supported by the housing, and another end portion configured to engage with the opening and closing unit;

a swing shaft attached to one of the swing member and the housing, configured for the swing member to rotate; and a second groove portion formed in the housing, configured to detachably engage and support the swing shaft.

7. The sheet conveyance apparatus according to claim 6, further comprising a second lock unit movable with respect to the second groove portion, configured to engage/release the swing shaft within/from the second groove portion.

8. The sheet conveyance apparatus according to claim 7, wherein the second lock unit includes a swing shaft regulating unit configured to be inserted/removed into/from the second groove portion, to one of restrict the swing shaft from exiting the second groove portion and allow the swing shaft to enter the second groove portion.

9. The sheet conveyance apparatus according to claim 6, wherein the opening and closing unit includes a guiding unit configured to guide the another end portion of the swing member, and wherein the another end portion of the swing member includes a guided unit configured to be guided by the guiding unit and move according to rotation of the opening and closing unit.

10. The sheet conveyance apparatus according to claim 1, wherein the shaft is configured to attach to the housing; and wherein the first groove portion is formed in the opening and closing unit.

11. The sheet conveyance apparatus according to claim 6, wherein the swing shaft is attached to the swing member, and wherein the second groove portion is formed in the housing.

12. The sheet conveyance apparatus according to claim 6, wherein the swing shaft is attached to the housing; and wherein the second groove portion is formed in the swing member.

13. The sheet conveyance apparatus according to claim 1, wherein the opening and closing unit includes:

a side regulating unit movable in a width direction perpendicular to a feeding direction of the at least one sheet, configured to regulate a position of the sheet supported by the support unit in the width direction; and an air separation unit configured to separate the at least one sheet by blowing air onto a sheet bundle supported by the support unit.

14. An image forming apparatus comprising:

the sheet conveyance apparatus according to claim 1; and an image forming unit configured to form an image on a sheet conveyed by the sheet conveyance unit.

* * * * *